US005728512A

United States Patent [19]

Yamashita

[11] Patent Number: 5,728,512

[45] Date of Patent: Mar. 17, 1998

[54] METHOD FOR PROCESSING SILVER HALIDE PHOTOGRAPHIC MATERIAL WITH A SPECIFIC FIXING SOLUTION

[75] Inventor: Hirobumi Yamashita, Hino, Japan

[73] Assignee: Konica Corporation, Japan

[21] Appl. No.: 752,197

[22] Filed: Nov. 19, 1996

Related U.S. Application Data

[63] Continuation of Ser. No. 552,288, Nov. 2, 1995, abandoned.

[30] Foreign Application Priority Data

Nov. 7, 1994 [JP] Japan ..... 6-272500

[51] Int. Cl.[6] ..... G03C 5/38

[52] U.S. Cl. ..... 430/455; 430/453

[58] Field of Search ..... 430/453, 455

[56] References Cited

U.S. PATENT DOCUMENTS

| | | | |
|---|---|---|---|
| 4,126,459 | 11/1978 | Greenwald | 430/455 |
| 4,444,873 | 4/1984 | Ishikawa et al. | 430/393 |
| 5,288,595 | 2/1994 | Watanabe et al. | 430/393 |
| 5,298,382 | 3/1994 | Toyoda et al. | 430/453 |
| 5,316,898 | 5/1994 | Ueda et al. | 430/393 |
| 5,580,705 | 12/1996 | Ueda et al. | 430/393 |
| 5,635,341 | 6/1997 | Yamashita et al. | 430/393 |

FOREIGN PATENT DOCUMENTS

| | | |
|---|---|---|
| 0371359 | 6/1990 | European Pat. Off. . |
| 0545645 | 6/1993 | European Pat. Off. . |
| 0620484 | 10/1994 | European Pat. Off. . |
| 0663613 | 7/1995 | European Pat. Off. . |

OTHER PUBLICATIONS

Patent Abstracts of Japan, vol. 006, No. 066, Apr. 27, 1982 & JP-A-57 006840 (Canon Inc.) Jan. 13, 1982 Abstract.

*Primary Examiner*—Hoa Van Le

*Attorney, Agent, or Firm*—Jordan B. Bierman; Bierman, Muserlian and Lucas

[57] ABSTRACT

Disclosed is a fixing solution for a silver halide light-sensitive material comprising a compound represented by Formula I:

$$R—(B)_n—CH_2—COOH \qquad \text{Formula I}$$

wherein R represents an alkyl group or an aryl group, provided that the alkyl group or the aryl group is substituted by at least one selected from the group consisting of a hydroxyl group, an amino group, a sulfo group, a nitro group and a halogen group; B represents a chemical bond selected from the group consisting of an ester bond, an amide bond, an ether bond and a thioether bond; n represents zero or one.

15 Claims, No Drawings

METHOD FOR PROCESSING SILVER HALIDE PHOTOGRAPHIC MATERIAL WITH A SPECIFIC FIXING SOLUTION

This application is a continuation of application Ser. No. 08/552,288, filed Nov. 2, 1995, now abandoned.

FIELD OF THE INVENTION

The present invention relates to a fixing solution for a silver halide light-sensitive photographic material and a method of processing the latter with the former. To be more specific, the present invention relates to a fixing solution and a method of processing the same with the use thereof, whereby drying property, residual color and storage property of the fixing solution at low temperature, are improved.

Further, the present invention relates to a fixing solution for a silver halide light-sensitive photographic material and a method of processing the same with the use of the fixing solution, whereby drying property, uneven drying and anti-staining property by fixing are improved.

BACKGROUND OF THE INVENTION

Consumption of silver halide light-sensitive photographic materials has increased worldwide.

Therefore, with the increase of the amount of exposed silver halide light-sensitive photographic materials to be developed, rapid processing of the material has also been increasing. In order to expedite the processing speed of the silver halide light-sensitive photographic materials, it is necessary to shorten the time of the respective processing steps. However, shortening of the processing time of the respective processing steps results in various disadvantages. For example, when the fixing time is shortened, color stain, or degraded image quality due to residual dyes in the light-sensitive material, often results. Further, shortening of drying time often causes uneven and insufficient drying. Thus development of technologies for overcoming these disadvantages has become urgent.

Moreover, concentrated fixing solutions have conventionally been stored as two parts, however, for the purpose of simplifying usage, replacement of the two parts with a single solution, has been demanded and it has become a common practice. However, by combining the fixing solution, there occurs the problem that the aluminium-type compound, which is a fixing-hardener, acetic acid, which is a buffer, and thiosulfate, which is the main fixing agent, tend to react with each other at low temperatures, and generate a salt which is basically insoluble. Then, a method of using a chelating agent or the aluminium compound was attempted. However, this was not an effective means of overcoming the disadvantages because it caused new problems such that the aluminium type compound was no longer effective as a hardener.

Moreover, in the viewpoint of protection of the environment, reduced use of the replenishing solution has also been demanded. When reduced quantity of the replenishing solution of the fixing solution is used, pH of the fixing solution rises due to carrying-in of a developing solution into the fixing solution, which has been known in the art to have an advertent effect of drying property of the photographic material. In order to restrain pH of the fixing solution from rising, increased amount of acetic acid has to be adapted, which, however results in increased production of the above-mentioned sparsely soluble salt.

According to the above-mentioned technical background, a new technology to improve drying property, residual color property and storage property at low temperatures has been demanded.

On the other hand, shortening of the processing time, for instance, shortening of the drying time, often causes insufficient drying or uneven drying, which subsequently causes a problem that uneven development takes place.

As a means for overcoming this disadvantage, increased use of aluminium-type compounds has been proposed, however, in the case when increased amounts of the compound is used, it often precipitates on the surface of the transporting rolls, which has caused problems not only in the transportation of the film but also in the storage property of the fixing solution. Further, in the viewpoint of protection of the environment, reduction of the replenishing solution has also been demanded, however, when reduction of the replenishing solution of the fixing solution is used, pH of the fixing solution rises easily due to carrying-in of a developing solution into the fixing solution, causing precipitation of the fixing hardener and pollution of the fixing solution, to result in the deterioration of the fixing property of the solution.

Accordingly, development of new technologies to improve drying property, uneven drying and fixing stain in has been demanded in the art.

Accordingly, the first object of the present invention is to provide a fixing solution suitably used for fixing a silver halide light-sensitive photographic material and a method of processing the same by the use thereof, whereby drying property, and fixing stain due to remaining dye and preservation property under processing at a low temperature have been improved.

The second object of the present invention is to provide a fixing solution suitably used for fixing a silver halide light-sensitive photographic material and a method of processing the same by the use thereof, whereby drying property, uneven drying and fixing stain have been improved.

SUMMARY OF THE INVENTION

The first object of the present invention has been achieved by the following items:

Item (1). A fixing solution for a silver halide light-sensitive photographic material comprising a compound represented by the following formula (I):

$$R—(B)_n—CH_2—COOH \qquad \text{Formula (I)}$$

wherein R represents an alkyl group or an aryl group which has been substituted by at least one selected from the group consisting of a hydroxyl group, an amino group, a sulfo group, a nitro group and a halogen group;

B represents a chemical bond selected from the group consisting of an ester bond, an amide bond, an ether bond and a thioether bond; n represents zero or one.

Item (2). The fixing solution for a silver halide light-sensitive photographic material according to item 1, which said fixing solution contains an aluminium-type gelatin hardener.

Item (3). A method of processing a silver halide light-sensitive photographic material which is characterized in containing a compound represented by formula (I).

Item (4). The method of processing a silver halide light-sensitive photographic material according to (3) above, wherein said method comprising a step of replenishing said fixing solution at a replenishing ratio not more than 400 $ml/m^2$.

The second objective of the present invention has been achieved by the following structures:

Item (5). A fixing solution for a silver halide light-sensitive photographic material, which is characterized in containing the compound represented by the above-mentioned general formula (I) and not containing an aluminium-type hardening agent.

Item (6). A method of processing a silver halide light-sensitive photographic material, which is characterized in comprising a step of processing said silver halide light-sensitive material with a fixing solution which contains a compound represented by the above-mentioned general formula (I) and which does not contain an aluminium-type hardening agent.

item (7). The method of processing a silver halide light-sensitive photographic material according to (6) above, wherein said method comprises a step of replenishing said fixing solution at a replenishing ratio not more than 400 $ml/m^2$.

Hereinbelow, the present invention is explained more in detail.

The invention described in items (1) through (4) above of the present invention relates to a fixing solution and a method of processing the same by the use thereof, wherein said fixing solution contains a compound represented by the formula (I), and, thereby, improvement in residual color in the rapid processing and drying property has been achieved. In addition thereto, by the above-mentioned, production of basically insoluble salts, which has heretofore been worried in the art, has effectively been prevented.

On the other hand, the invention described in items (5) through (7) above relates to a fixing solution and a method of processing the same by the use thereof, wherein said fixing solution does not contain aluminium type hardening agent and contains a compound represented by formula (I), whereby improvement in the drying property and prevention of uneven drying have been achieved even in the system where aluminium type hardening agent is not present, and, in addition, occurrence of staining due to the aluminium type compound precipitated on the fixing roll, etc. can be prevented.

In the general formula(I), R represents an akyl group such as methyl group, ethyl group, propyl group, iso-propyl group, a higher alkyl group or an aryl group such as phenyl group or naphthyl group wherein the alkyl group or the aryl group may be substituted by at least one selected from the group consisting of a hydroxyl group, an amino group, a sulfo group, a nitro group and a halogen atom; B represents an ester bondage, an amide bondage, an ether bondage or a thioether bondage.

In the above-mentioned general formula (I), it is preferable that R represents a hydroxyl group, an amino group, a sulfo group or a halogen substituted alkyl group having a carbon number of not more than 5, and n is preferably zero.

In the view of attaining the second object of the present invention, R in the general formula (I) is preferably an amino group.

Specific examples of the compound represented by formula (I) of the present invention are given below, however, it should be understood that the present invention is by no means restricted to such specific examples.

1. $HO—CH_2CH_2COOH$
2. $HO—CH_2—CH_2—CH_2COOH$
3. $HO—CH_2—CH_2—CH_2—CH_2COOH$
4. $CH_3—CH(OH)—CH_2COOH$
5. $CH_3—CH(OH)—CH_2—CH_2COOH$
6. $H_2N—CH_2—CH_2COOH$
7. $H_2N—CH_2—CH_2—CH_2COOH$
8. $H_2NCH_2—CH_2—CH_2—CH_2COOH$
9. $HO_3S—CH_2—CH_2COOH$
10. $HO_3S—CH_2—CH_2—CH_2COOH$
11. $HO_3S—CH_2—CH_2—CH_2—CH_2COOH$
12. $O_2N—CH_2—CH_2COOH$
13. $O_2N—CH_2—CH_2—CH_2COOH$
14. $O_2N—CH_2—CH_2—CH_2—CH_2COOH$
15. $Cl—CH_2—CH_2COOH$
16. $Cl—CH_2—CH_2—CH_2COOH$
17. $Cl—CH_2—CH_2—CH_2—CH_2COOH$
18. $Br—CH_2—CH_2COOH$
19. $Br—CH_2—CH_2—CH_2COOH$
20. $CH_3—CHBr—CH_2COOH$
21. $Br—CH_2—CH_2—CH_2—CH_2COOH$
22. $I—CH_2—CH_2COOH$
23. $H_2N—CH_2—CH(OH)—CH_2—CH_2COOH$
24. $HO—CH_2—C(CH_3)_2—CH(OH)—CO—NH—CH_2COOH$
25. $H_2N—CH(OH)—CH_2—CH_2—CH_2COOH$

These compounds represented by formula (I) of the present invention can be synthesized easily according to a conventional method, for example, the method disclosed in *Shinjitsuken Kagaku Koza* published by Maruzen.

The added amount of the compound represented by the formula (I) to a fixing solution is preferably, of 0.05 to 3 mols per liter of a fixing solution and, more preferably, of 0.1 to 2 mols/l. These compounds may be used either individually or two or more kinds in combination. They may be used together with acetic acid. Further, they may be added in the form of a sodium salt or a potassium salt.

Next the processing steps according to the present invention are explained with reference to development and fixing in the order below.

First, developing solution is explained.

Specific developing agents used in the present invention includes the following compounds. As for black-and-white developing agent, for example, dihydroxybenzene type compounds, such as hydroquinone, chlorohydroquinone, bromohydroquinone, dichlorohydroquinone, isopropylhydroquinone, methylhydroquinone, 2,3-dichlorohydroquinone, methoxyhydroquinone, 2,5-dimethylhydroquinone, potassium hydroquinone monosulfonate and sodium hydroquinone monosulfonate; 3-pyrazolidone type compounds such as 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4hydroxymethyl-3-pyrazolidone, 1-phenyl-4,4-dihydroxymethyl-3-pyrazolidone, 1-p-toluyl-3-pyrazolidone, 1-phenyl-2-acetyl-4,4-dimethyl-3-p-toluyl-3-pyrazolidone, 1-(2-benzthiazole)-3-pyrazolidone and 3-acetoxy-1-phenyl-3-pyrazolidone; aminophenol type compounds such as o-aminophenol, p-aminophenol, N-methyl-o-aminophenol, N-methyl-p-aminophenol and 2,4-diaminophenol; 1-allyl-3-aminopyrazoline type compounds such as 1-(p-hydroxyphenyl-3-aminopyrazoline, 1-(p-methylaminophenyl)-3-aminopyrazoline and 1-(p-amino-m-methylphenyl-3-aminopyrazoline; ascorbic acid; an ascorbic acid derivative; pyrazolone type compounds such as 4-aminopyrazolone; and a mixture thereof can be mentioned.

In the developing solution used in the present invention, if necessary, other additives which are known in the art may also be used in addition to those compounds mentioned above, including, for example, a preservative such as a sulfite and a metasulfite compound; a buffer such as a carbonate, a borate and an alkanolamine; an alkaline agent such as a carbonate; a solubilization aid such as polyethyleneglycol and an ester thereof; a pH adjustor such as an organic acid like citric acid; a sensitizing agent such as a quarternary ammonium salt; a development accelerator; a gelatin hardener such as a dialdehyde compound like glutaldehyde and a surface active agent may be used. Further, as an anti-foggant, an azoie-type compounds, for example, an indazole-type, imidazole-type, benzimidazole-type, triazole-type, benztriazole-type, tetrazole-type and thiadiazole-type compounds and a blocking agent such as sodium hexametaphosphoric acid, calcium hexametaphosphoric acid and a poly phosphoric acid, which is used to block a carcium ion present in the running water used for the developing solution; etc., can be mentioned.

In the present invention, an anti-silver sludge inhibitor agent, for example those compounds disclosed in Japanese Patent O.P.I. Publication No.24347(1981) may be used. The developing solution used in the present invention is in the pH range of 9 to 13 and, more preferably, of 10 to 12.

In the developing solution used in the present invention, am amino compound such as alkanolamine, which is disclosed in Japanese Patent O.P.I. Publication No.106244 (1981) can be used. Further, those compounds disclosed on pages 22 through 229 of "*Photographic processing Chemistry*", written by L.F.A. Meson and published by Focal Press Ltd.(1966); U.S. Pat. Nos.2,193,015 and 2,592, 364 and Japanese Patent O.P.I. Publication No.6493(1973) may also be used.

Next the fixing solution used in the present invention is explained.

In the fixing solution according to the present invention, a compound represented by the above-mentioned formula (I) is used. As for other fixing agent used in the present invention, a thiosulfate compound is preferable. Said thiosulfate compound is supplied in the form of a solid and, more specifically, it is supplied in the form of a lithium, potassium, sodium or ammonium salt, preferably, it is supplied in the form of sodium thiosulfate or ammonium thiosulfate and is used after being dissolved in water. In view of rapid processing, it is more preferable that the fixing agent is supplied in the form of an ammonium salt, and is used after dissolution. In the viewpoint of storage stability, it is preferable that the fixing agent is supplied in the form of a sodium salt.

Preferable concentration of the above-mentioned thiosulfate is of 0.1 to 5 mols/l, more preferably of 0.8 to 2 mols/l and, particularly preferably of 0.7 to 1.8 mols/l. As the other fixing agent, an iodide and a thiocyanate may be used.

The fixing solution according to the present invention comprises a sulfite and when mixing of the thiosulfate and the sulfite, the concentration of the sulfite at the time of dissolution not more than 0.2 mol/l. As for the above-mentioned sulfite, for example, solid lithium salt, solid potassium salt, solid sodium salt and solid ammonium salt, etc., may be employed and they are used by being dissolved together with the above-mentioned solid thiosulfate salt.

The fixing solution disclosed in items (1) through (4) preferably contains an aluminium-type hardening agent. Said aluminium-type hardening agent is a compound which is soluble in the fixing solution, and is capable of releasing an aluminium ion or an aluminium complex ion. Preferably, they are added to the fixing solution in the form of aluminium sulfate or alum. Further, the fixing solution according to the present invention may contain citric acid, tartaric acid, malic acid, succinic acid, phenylacetic acid and an optical isomer thereof.

Further, for example, potassium citrate, lithium citrate, sodium citrate, ammonium citrate, lithium hydrogen tartarate, potassium hydrogen tartarate, potassium tartarate, sodium hydrogen tartarate, sodium tartarate, ammonium hydrogen tartarate, potassium ammonium tartarate, sodium potassium tartarate, sodium maliate, ammonium maliate, sodium succinate or ammonium succinate may also be used.

Among the above-mentioned, the preferable compounds are citric acid, isocitric acid, malic acid, phenylacetic acid and a salt thereof.

The above-mentioned citric acid, tartaric acid, malic acid, succinic acid, etc. are supplied in the form of solid and is used by dissolving in an aqueous-type solvent. Preferable concentration of these compounds in the fixing solution after dissolution is not less than 0.05 mol/l and, most preferable concentration is of 0.2 to 0.6 mol/l.

As for the acid, for example, salts of an inorganic acid such as sulfric acid, hydrochloric acid, nitric acid and boric acid, and a salts of an organic acid such as formic acid, propionic acid and tartaric acid can be mentioned. Preferably, acids such as boric acid or aminopolycarboxylic acid and salts thereof. Preferable added amount is 0.2 to 0.6 mol/l.

As for chelating agent used in the fixing solution according to the present invention, for example, aminopolyacetic acid and salts thereof, such as nitrilotriacetic acid, ethylenediaminetetraacetic acid can be mentioned.

As for the surface active agent used in the fixing solution according to the present invention, for example, anionic active agent such as esterification compound of sulfuric acid and sulfonates; nonionic active agent such as a polyethyleneglycol compound or an ester type compound and amphoteric surfactants disclosed in Japanese Patent O.P.I. Publication No.6840(1982) can be mentioned.

As for wetting agent used in the fixing solution according to the present invention, for example, alkanolamine alkyleneglycol can be mentioned.

As for the fixing accelerator used in the present invention, for example, thiourea derivatives disclosed in Japanese Patent O.P.I. Publication No.35754(1970), Japanese Patent Examined Publication Nos.122535(1983) and 122536 (1983); alcohol having a triple bond in the molecule;and thioethers disclosed in U.S. Pat. No. 4,126,459 can be mentioned.

The fixing solution according to the present invention has preferably a pH value of not less than 3.8 and, more preferably, of 4.2 to 5.5. Further, the replenishing amount of the fixing solution is preferably not more than 400 ml/m$^2$, and, more preferably, 50 to 350 ml per square meter of the silver halide light-sensitive material.

The fixing solution disclosed in items (5) through (7) does not contain the aluminium-type hardening agent. However, other constituents of the fixing solution is as mentioned above.

Next, the silver halide light-sensitive photographic material employed in the present invention is explained.

First silver halide emulsion is explained.

The silver halide emulsion used in the present invention may consist of a single kind or of a mixture of two or more kinds of different silver halide emulsions. The emulsions to be mixed may be ones containing tabular-shaped silver halide grains or one containing regular-shaped grains or twin crystals whose average aspect ratio is less than 2. Moreover, silver halide emulsion layer may consist of a single layer or of a plurality of layers.

Silver halide grains to be employed in the present invention are preferably those having the average grain diameter or thickness not more than 0.3 μm. In the present invention the term thickness of the silver halide grain is defined as denotes the minimum distance between pairs of parallel main planes which constitute a grain.

The above-mentioned thickness of the silver halide grain may be obtainable by depositing a metal by vacuum evaporation obliquely from behind together with comparative latex particles and measuring the length of a shadow of silver halide grains with reference to that of the latex particles, or from electron-microscopic cross-section image of the grains, which were coated on a substrate and dried.

The silver halide emulsion used in the present invention is preferably one containing so-called mono-disperse grains and particularly, one containing silver halide grains, 50% or more by weight of the total silver halide grains have a grain size within 20% around the average grain size is preferable.

Composition of the silver halide used in the silver halide emulsion used in the present invention is optional and may be selected from the group consisting of silver chloride, silver bromide, silver chlorobromide, silver iodobromide and silver iodochlorobromide. In the light of high sensitivity, salver bromide or silver iodobromide is preferable. In this case, the average silver iodide content is 0 to 5.0 mol % and, most preferably 0.1 to 3.0 mol %.

On the manner of manufacturing a silver halide emulsion containing tabular-shaped silver halide grains, for example, Japanese Patent O.P.I. Publication Nos.113926(1983), 113927(1983), 113934(1983 and 1855(1987), European Patent Nos.219,849 and 219,850 can be used as references. Further as to the manner of manufacturing a silver halide emulsion containing mono-disperse tabular-shaped grains, Japanese Patent O.P.I. Publication No.6643(1986) can be referred. A silver halide emulsion containing tabular-shaped grains having high aspect ratio can be obtained by simultaneously adding an aqueous silver nitrite solution or simultaneously adding an aqueous silver nitrite solution and an aqueous halide solution to an aqueous gelatin solution having pBr being maintained at a value of not more than 2, to generate seed grains and, then grow the grains by double-jet mixing process.

The grain size of the above mentioned tabular-shaped grain may be controlled by adjusting the temperature at the time of generation of grains, and/or adding rate of the aqueous silver or halide solution. Aspect ratio may be regulated by varying manner of production of the seed grain, thickness, pAg, pH, halide composition, ripening time and temperature. Further, at the time of manufacturing the tabular-shaped silver halide grains, if necessary, a solvent of silver halide such as ammonia thioether or thiourea may be used.

Growth of the silver halide grains may be carried out by supplying an aqueous solution containing silver ion and an aqueous solution containing halide ion. it may also be done by supplying fine silver halide particles.

In this case, any combination of silver iodide, silver iodobromide, silver bromide, silver chlorobromide, silver chloride, halide ion-containing solution and silver ion-containing solution can be used.

As for one preferable example of the silver halide emulsion according to the present invention, so-called a core/shell-type, or double layer-structured silver halide grains, in which silver halide composition inside the grain and that at the surface thereof is different, may also be used preferably. The manner of preparing the core/shell silver halide grains are disclosed in detail in, for example, U.S. Pat. Nos.3,505,068 and 4,444,877; British Patent No. 1,027,146 and Japanese Patent O.P.I. Publication No.14331(1985). Silver iodide content of the core/shell-type silver grains at the outermost surface thereof is preferably less than 5 mol % and, more preferably, less than 3 mol %.

The silver iodide content of the outermost surface of the silver halide grains used in the present invention can be measured by various measuring means of elemental analysis of the surface. For example, XPS, i.e., x-ray photoelectron spectroscopy, Auge electron spectroscopy and ISS are effective. XPS is the simplest and the most accurate means and the silver iodide content of the outermost surface of the silver halide grains according to the present invention can be defined as a value measured by this method.

Depth which analyzed by the XPS method is considered to be approximately 10 angstroms. The principles of the XSP method applied to the analysis of the surface portion of the silver halide grain, for example, "Spectroscopy of electrons" written by Junichi Aihara, *Kyoritsu Library No.*16, published by Kyoritsu Shguppan Co. Ltd.(1981) can be referred to.

The above-mentioned silver halide emulsion may be either type of emulsion containing silver halide grains in which latent image is formed on the surface thereof, inside thereof, or both. These emulsions may be incorporated, at the time of physical ripening or preparation of silver halide grains, with various kinds of metal salts or metal complexes such as a cadmium salt, a zinc salt, a thalium salt, a ruthenium salt, an osmium salt, an iridium salt or a complex thereof and a rhodium salt or a complex thereof.

To the above-mentioned silver halide emulsion an appropriate washing method such as noodle method or floccuration precipitation method can be applied for the purpose of removing soluble salts from the reaction system. As for especially preferable desalination methods applied to the silver halide emulsion according to the present invention, for example, a method of using an aromatic aldehyde resin containing a sulfo group, disclosed in Japanese Patent Publication No.16086(1960) and a method of using floccuration polymer examples G3, G8, etc., as disclosed in Japanese Patent O.P.I. Publication No.158644(1988) can be mentioned as preferable desalination methods.

As for chemical sensitization, which is applicable to the silver halide light-sensitive photographic material used in the present invention, any chemical sensitizing methods, which are conventionally known and used in the art, including, for example, sulfur sensitization, sensitization by the use of a selenium compound, sensitization by the use of a Te-compound, gold sensitization, sensitization by the use of a noble metal compound of VIII-family elements of the periodical table, and any combined sensitization method by the use of any combined methods and compounds mentioned above, can be applied. Among these methods mentioned above, combined use of gold sensitization with sulfur or selenium sensitization is particularly preferable. Further, it is also preferable to carry out chemical sensitization together with reduction sensitization.

In the viewpoint of obtaining enhanced sensitivity and adsorption of sensitizing dyes, it is preferable to supply iodide ion at the time during or completion of chemical sensitization.

It is also advantageous to carry out chemical sensitization in the presence of a compound, which is capable of being adsorbed to the silver halide grains.

As for such compounds, for example, azoles, diazoles, triazoles, tetrazoles, indazoles, thiazoles, pyrimidines, azaindenes and those compounds having a mercapto group or a benzene ring in the compounds mentioned above.

Reduction treatment in the present invention, or reduction sensitization can be performed either one of the following methods: a method of adding a reductive compound; a method of undergoing a condition of excess silver ion, or so-called "silver ripening, under which pAg value is maintained between one (1) and seven (7); and a method of undergoing high pH condition, or so-called "high pH ripening", under which pH value is between eight (8) and eleven (11); these methods can be applied either individually or two or more kinds in combination.

The method of using a reductive compound is advantageous from a viewpoint that degree of reduction sensitization can be controlled minutely.

The above-mentioned reductive compounds may be either of organic or inorganic, including, for example, thiourea dioxide, a stannous salt, amines and polyamines, hydrazine derivatives, a formamidine sulfinic acid, a silane compound, a borane compound, ascorbic acid or a derivative thereof and a sulfite can be mentioned, and, particularly preferably, thiourea dioxide, stunnous chloride and dimethylamine borate can be mentioned. Amount of addition of these reductive compounds may be different depending upon manufacturing conditions of the silver halide emulsion, such as reductivity of the compound to be used, kind of silver halide used and conditions for dissolution, however, an amount between $1\times10^{-8}$ and $1\times10^{-2}$ mol per a mol of silver halide is generally appropriate. These reductive compounds are added to the silver halide emulsion during growth step of the silver halide grains after dissolving in a solvent such as water or an alcohol.

In the present invention, the reduction treatment is preferably performed on an optional portion and/or a shell portion of the silver halide except the outermost shell portion thereof, and, subsequently, growth of the grain is carried out, and, in view of controlling effect of the sensitization, it is preferable that the sensitization is performed on an inner shell surface, for example on the surface of seed grains or on the shell surface, when the growth of the grain is paused.

The reduction treatment according to the present invention may be carried out in the presence of a thiosulfonic acid compound disclosed in, for example, Japanese Patent Publication Nos.135439(1990) and 135852(1990).

The silver halide light-sensitive photographic material used in the present invention can be sensitized optically by the use of a methine dye or other spectral sensitizing dyes. Such dyes, which are applicable in the present invention include, for example, cyanine dyes, merocyanine dyes, composite cyanine dyes, holopolar cyanine dyes, hemicyanine dyes, styryl dyes, and hemioxonol dyes. Particularly preferable dyes among these are cyanine dyes, merocyanine dyes and composite merocyanine dyes. To these dyes, any nucleus which is commonly used in the art can be applied. That is to say, any of the following nucleii may be used: a pyroline nucleus, a oxazoline nucleus, a thiazoline nucleus, a pyrole nucleus, an oxazole nucleus, a thiazole nucleus, a selenazole nucleus, an imidazole nucleus, a tetrazole nucleus, a pyridine nucleus and a nucleus in which a hydrocarbon ring is fused with the above-mentioned nucleii, e.g., an indolenine nucleus, a benzindolenine nucleus, an indole nucleus, a benzoxazole nucleus, a naphthoxazole nucleus, a benzthiazole nucleus, a naphthothiazole nucleus, a benzselenazole nucleus, a benzimidazole nucleus and a quinoline nucleus can be mentioned. These nucleii can have a substituent on the carbon atom.

To the above-mentioned merocyanine dyes or composite merocyanine dyes, a 5-member or 6-member heterocyclic nucleus such as a pyrazoline-5-one nucleus, a thiohydantoine nucleus, 2-thiooxazalidine-2,4-dione nucleus, a rhodanine nucleus and a thiobarbituric acid nucleus may be applied as a nucleus containing a ketomethine structure in the molecule.

These sensitizing dyes may be used either individually or two or more kinds in combination.

In the present invention the sensitizing dye can be added to the silver halide emulsion at an optional time, for example, at the time of production of silver halide grains, before, during or after chemical ripening and before coating, etc., however, it is preferable for the sensitizing dye to be added at several points.

In the light-sensitive material used in the present invention, a crossover light-blocking layer may be provided between the support and the silver halide emulsion layer. The above-mentioned crossover light-blocking layer may be an undercoat, which is provided between the support and a hydrophilic colloidal layer. Further, a dye-containing layer or, solid dye-dispersion layer may be provided between the subbing layer and the silver halide emulsion layer. As for the dye used in the above-mentioned subbing layer, for example, oxonol dyes having a pyrazolone or a barbitur nucleus, azo dyes, azomethine dyes, anthraquinone dyes, arylidene dyes, stiryl dyes, triarylmethane dyes, merocyanine dyes, and cyanine dyes can be mentioned. The dye used in the above-mentioned dye layer may be dispersed in the form of fine poarticles. As for specific dyes, those exemplified compounds I-2, 4, 6, 8, 9, 10, 11, 12 and 13 through 27; II-2, 5 and 6; III-3, 4, 6, 8, 9, 10, 11, 12 and 14through 28; IV-3, 5, 6, 8 and 10 through 16 and V-3, 5, 6, and 7, disclosed in Japanese Patent O.P.I. Publication No.264247(1990) can be mentioned.

In the silver halide emulsion used in the present invention, a variety of photographic additives can be incorporated in the steps of physical ripening or in the step before or after chemical ripening. For example, hydrazine compounds, such as those disclosed in Japanese Patent Application No.134743(1993), and, particularly those represented by the general formula (5), are used preferably. As for nucleus-creation accelerlator, those represented by the general formulae (7) and (8) are preferable. Further a tetrazolium compound such as those disclosed in Japanese Patent Publication No.250050(1990) are particularly preferable. As for other conventionally known photographic additives, for example those compounds disclosed in the Research Disclosure Nos.17,643(December 1978), 18,716 (November 1979) and 308,119(December 1989) can be mentioned. Nature of the compounds and locations of reference to these Research Disclosures are given as follows.

| | RD-17643 | | RD-18716 | | RD-308119 | |
|---|---|---|---|---|---|---|
| Additive | Page | Category | Page | Category | Page | Category |
| Chemical sensitizer | 23 | III | 648 upper right | | 996 | III |
| Sensitizing dye | 23 | IV | 648–649 | | 996–8 | IV |
| Desensitizing | 23 | IV | | | 998 | B |
| Dye | 25–26 | VIII | 649–650 | | 1003 | VIII |
| Development accelerator | 29 | XXI | 648 upper right | | | |
| Anti-foggant, stabilizer | 24 | IV | 649 upper right | | 1006–7 | VI |

-continued

| | RD-17643 | | RD-18716 | | RD-308119 | |
|---|---|---|---|---|---|---|
| Additive | Page | Category | Page | Category | Page | Category |
| Brightening agent | 24 | V | | | 998 | V |
| Hardener | 26 | X | 651 left | | 1004–5 | X |
| Surfactant | 26–7 | XI | 650 right | | 1005–6 | XI |
| Anti-static agent | 27 | XII | 650 right | | 1006–7 | XIII |
| Plasticizer | 27 | XII | 650 right | | 1006 | XII |
| Lubricant | 27 | XII | | | | |
| Matting agent | 28 | XVI | 650 right | | 1008–9 | XVI |
| Binder | 26 | XXII | | | 1003–4 | IX |
| Support | 28 | XVII | | | 1009 | XVII |

As for support which may be applied to the light-sensitive material according to the present invention, for example, those disclosed on page 1009 of the above-mentioned RD-308,119 and on page 28 of RD-17,643 can be mentioned. Further, polyethylene-2,6-naphthalate may also be used. As the most appropriate support, a plastic film, etc. may be mentioned. The surface of these support material may be treated, for the purpose of improving adhesion to the layer to be coated thereupon, with corona discharge or ultraviolet-ray irradiation, or by providing one or more subbing layers on it.

EXAMPLES

Hereinbelow, the present invention is further explained with reference to working examples, however, the scope and embodiment of the present invention is not limited by these examples.

Example 1

First, light-sensitive material for evaluation was prepared as follows.

(Preparation of light-sensitive material)

Preparation of Seed emulsion-1

| | |
|---|---|
| <Solution A1> | |
| Ossein gelatin | 24.2 g |
| Water | 9657 ml |
| Sodium salt of polypropyreneoxy-polyethyleneoxy-disuccinate (10% aqueous ethanol solution) | 6.78 ml |
| Potassium bromide | 10.8 g |
| 10% nitric acid | 114 ml |
| <Solution B1> | |
| 2.5N-aqueous silver nitrite | 2825 ml |
| <Solution C1> | |
| Potassium bromide (diluted with water to 2825 ml) | 841 g |
| <Solution D1> | |
| 1.75N-aqueous potassium bromide solution | |

At 42° C., using a mixing machine as shown in Japanese Patent Examined Publication Nos.53288(1983) and 58289 (1983), each 464.3 ml of <Solution B1> and <Solution C1> is added to <Solution A1>, by simultaneous mixing method spending 1.5 minutes, to generate nucleii.

After addition of <Solution B1> and <Solution C1> was stopped, temperature of the mixed solution was raised up to 60° C. spending 60 minutes, and after adjusting pH of the mixed solution at 5.0 with 3% KOH, <Solution B1> and <Solution C1> were added again to <Solution A1> by simultaneous mixing method for another 42 minutes at an adding rate of 55.4 ml/min respectively. While the temperature of the mixed solution was raised from 42° C. to 60° C. and <Solution B1> and <Solution C1> are mixed again simultaneously, silver potential (measured with a silver ion selective electrode using a saturated silver - silver chloride electrode as a comparative electrode) was regulated at +6 mV and +8 mV, respectively.

After completion of the addition, pH was adjusted at 6 with 3% KOH and, immediately thereafter, desalting and washing were carried out. Through electron-microscopic observation, it was found that this seed emulsion contained silver halide grains, in which not less than 90% of the total projection area consists of hexagonal tabular shaped grains having the maximum adjacent side ratio of 1.0 to 2.0, average thickness 0.064 μm and average grain diameter in terms of the diameter of a circle having equivalent projection area) of 0.595 μm, respectively. Further, coefficient of variation of thickness was 40%, and the coefficient of variation of distance between twin planes was 42%.

Preparation of Em-1

Silver halide emulsion containing tabular silver halide grains was prepared using the seed emulsion-1 and four kinds of solutions shown below:

| | |
|---|---|
| <Solution A2> | |
| Ossein gelatin | 34.03 g |
| Sodium salt of polypropyleneoxy-polyethyleneoxy-disuccinate (10% aqueous ethanol solution) | 2.25 ml |
| Seed emulsion-1 | 1.218 mol equivalent |
| Add water to make the total volume | 3150 ml |
| <Solution B2> | |
| Potassium bromide (finished up at 3644 ml with water) | 1734 g |
| <Solution C2> | |
| Silver nitrite (finished up at 4165 ml with water) | 2478 g |
| <Solution D2> | |
| Fine-grain emulsion* comprising 3% by weight of Gelatin and fine silver iodide grains having an average grain size of 0.05 μm | 0.080 mol equivalent |

(*) This emulsion was prepared by adding 2 liters each of an aqueous solution containing 7.06 mols of silver nitrite and an aqueous solution containing 7.06 mols of potassium iodide to 6.64 1 of an aqueous 5 wt % gelatin solution containing 0.06 mol potassium iodide for 10 minutes. pH of the mixed solution during the generation of fine grains was adjusted at 2.0 with nitric acid, and the temperature was controlled at 40° C. After formation of grains, pH of the emulsion was with an aqueous sodium carbonate solution.

While maintaining the temperature of the solution at 60 C., <Solution A2> was agitated vigorously in a reaction vessel, and, thereto, a part of <Solution B2> and a part of <Solution C2> and a half amount of <Solution D2> were added by simultaneous mixing method for five minutes. Then, half amount of the residual <Solution B2> and <Solution C2> were added spending 37 minutes and, subsequently, a part of <Solution B2> and a part of <Solution C2> and the whole amount of <Solution D2> were added spending 15 minutes, and, finally, the whole amount of residual <Solution B2> and <Solution C2> were added spending 33 minutes. During the addition, pH and pAg of the mixed solution were maintained at 5.8 and 8.8, respectively. Moreover, rate of addition of <Solution B2> and <Solution C2> was varied functionally with respect to time corresponding to the critical growth rate.

Further, 0.15 mol % equivalent amount with respect to the total silver amount of <Solution D2> was added, to carry out halide conversion. After completion of the addition the temperature of this emulsion was cooled down to 40° C., and added 1800 ml of aqueous solution containing 13.8% by weight of a gelatin derivative, in which gelatin was modified with a phenylcarbamoyl group as a coagulating polymer, and stirred for three minutes. Then added 56% by weight of aqueous acetic acid solution, to adjust pH of the emulsion at 4.6, and stirred for three minutes. Then, after leaving still for 20 minutes drained off the top clear part by decantation. Thereafter, 9.0 liters of 40° C. distilled water was added, stirred and left still, and the top clear part was drained off. Subsequently thereafter, an aqueous gelatin solution and 10% by weight of aqueous sodium cabonate solution were added, to adjust pH of the emulsion at 5.80, stirred at 50° C. for 30 minutes, and re-dispersed. After the re-dispersion, the emulsion was adjusted to have pH of 5.80 and pAg of 8.06.

Electron-microscopic observation of the thus obtained emulsion has revealed that this silver halide emulsion comprises tabular-shaped silver halide grains, average grain size, average grain thickness, average aspect ratio and width of distribution of the grain size were 1.11 μm, 0.25 μm, 4.5 and 18.1%, respectively. Further, average distance between parallel twin planes was 0.020 μm and proportion of grains (in number) having a ratio of the distance between parallel twin plane over thickness of thereof was 97% (more than 5), 49% (more than 10) and 17% (more than 15), respectively.

Next, after raising the temperature of the above-mentioned silver halide emulsion Em-1 to 60° C., predetermined amount of spectral sensitizing dye was added in the form of a dispersion of fine solid particles, and, thereafter, a mixed aqueous solution containing adenin, ammonium thiocyanate, chloroauric acid and sodium thiosulfate and a dispersion of triphenylphosphinic selenide were added and 60 minutes thereafter, silver iodide emulsion containing silver halide fine particles was added, thus to undergo ripening for the total period of 60 minutes. At the time of completion of the ripening, predetermined amount of 4-hydroxy-6-methyl-1,3,3a,7-tetrazaindene was added as a stabilizing agent.

The above-mentioned additives and the amount thereof used per a mol of silver halide are given below:

| | |
|---|---|
| Sodium salt of 5,5'-dichloro-9-ethyl-3,3'-di-(4-sulfopropyl)oxacarbocyanine anhydride | 2.0 mg |
| Sodium salt of 5,5'-di-(butoxycarbonyl)-3,3'-di-(4-sulfobutyl)-benzimidazolocarbocyanine anhydride | 120 mg |
| Adenin | 15 mg |
| Potassium thiocyanate | 95 mg |
| Auric acid chloride | 2.5 mg |
| Sodium thiosulfate | 2.0 mg |
| phenylphosphine selenide | 0.4 mg |
| Fine grains of silver iodide | 280 mg |
| 4-Hydroxy-6-methyl-1,3,3a,7-tetrazaindene (TAI) | 500 mg |

The dispersion in the form of solid fine particles of the spectral sensitizing dye was prepared according to the method disclosed in Japanese Patent Application No.99437 (1992): That is to say, it was obtained by adding a predetermined amount of spectral sensitizing dye to water, which was adjusted in advance at 27° C., and, then, by agitating the solution with a high-speed dessolver at 3,500 r.p.m. for 30 to 120 minutes.

The above-mentioned dispersion of the spectral sensitizing dye was prepared in the following manner. That is to say, 120 g of triphenylphosphine selenide was added to 30 kg of ethyl acetate and then stirred and dissolved completely. On the other hand, 3.8 kg gelatin was dissolved in 38 kg of pure water, and, to this solution 93 g of an aqueous solution containing 25% by weight of triphenylphosphine selenide was added. Then, these two solutions were mixed and dispersed minutes using a high speed mixing-type dispersing machine with rotary wings the peripheral speed at 40 m/sec for 30 minutes.

Immediately thereafter, ethyl acetate was removed by agitation under reduced pressure until residual ethyl acetate concentration became not more than 0.3% by weight. Then this dispersion was finished up at 80 kg by diluting with pure water. A part of the thus obtained dispersion was taken out and used for the above-mentioned experiment.

The average silver iodide content of the silver halide grains contained in the silver halide emulsion Em-1 prepared by adding the above-mentioned fine grains of silver iodide was about 4 mol %.

Next, by adding below-mentioned additives, to the thus sensitized silver halide emulsion Em-1, to prepare coating solutions. A coating solution for a protective layer was also simultaneously prepared.

Then, on both surfaces of a polyethyleneterephthalate film substrate (thickness of 175 μm) for X-ray, which was dyed in advance in blue color at a density of 0.15, and with which a crossover light-blocking layer as shown below is provided, following layers, of which compositions and amount of the coating solutions are given below, were provided in the order and, then, dried.

First layer(crossover light-blocking layer)

| | |
|---|---|
| Dispersion in the form of solid fine dye particles (AH) | 180 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (average diameter: 0.014 μm) | 10 mg/m$^2$ |

Second layer (silver halide emulsion layer)

Following additives were added to the above-mentioned emulsion Em-1

| | |
|---|---|
| Compound (G) | 0.5 mg/m$^2$ |
| 2,6-bis(hydroxylamino)-4-diethylamino-1,3,5-triazine | 5 mg/m$^2$ |
| t-butyl-catecol | 130 mg/m$^2$ |
| Polyvinyl pyrrolidone (molecular weight: 10,000) | 35 mg |
| Styrene-maleic acid anhydride | 80 mg/m$^2$ |
| Sodium polystyrene sulfonate | 80 mg/m$^2$ |
| Trimethylolpropane | 350 mg/m$^2$ |
| Diethyleneglycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica | 0.5 g/m$^2$ |
| Latex (L) | 0.2 mg/m$^2$ |
| Dextrin (average molecular weight of 1000) | 0.2 g/m$^2$ |
| Amount of gelatin coated was adjusted to be 1.0 g/m$^2$ | |

Third layer (protective layer)

| | |
|---|---|
| Gelatin | 0.8 g/m$^2$ |
| Matting agent made of polymethylmethacrylate (area average particle size: 7,0 μm) | 50 mg/m$^2$ |
| Formaldehyde | 20 mg/m$^2$ |
| Sodium salt of 2,4-dichloro-6-hydroxy-1,3,5- | 10 mg/m$^2$ |

-continued

| | |
|---|---|
| triazine | |
| Bis-vinylsulfonylmethyl ether | 36 mg/m$^2$ |
| Latex (L) | 0.2 g/m$^2$ |
| Polyacrylamide (average molecular weight of 10,000) | 0.1 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (0) | 50 mg/m$^2$ |
| Compound (S-2) | 5 mg/m$^2$ |
| $C_9F_{19}$—O—$(CH_2CH_2O)_{11}$—H | 3 mg/m$^2$ |
| $C_8F_{17}SO_2N(C_3H_7)$—$(CH_2CH_2O)_{15}$—H | 2 mg/m$^2$ |
| $C_3F_{17}SO_2N(C_3H_7)$—$(CH_2CH_2O)_4$—$(CH_2)_4$—$SO_3Na$ | 1 mg/m$^2$ |

Compound (G)

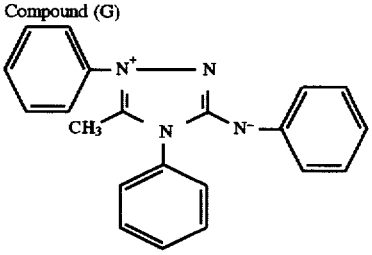

Compound (H)

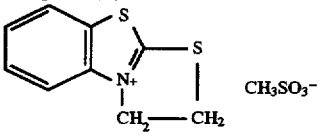

Compound (I)

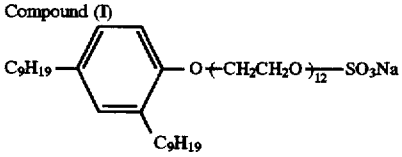

Compound (J)

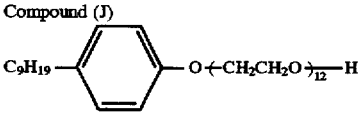

Compound (K)

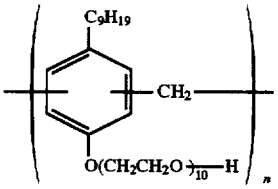

(mixture of n = 2–5)

Compound (S-1)

$NaO_3S$—CHCOO$(CH_2)_2CH(CH_3)_2$
|
$CH_2COO(CH_2)_9CH_3$

Compound (S-2)

$NaO_3S$—CHCOO$CH_2(C_2F_4)_3H$
|
$CH_2COOCH_2(C_2F_4)_3H$

-continued

Latex (L)

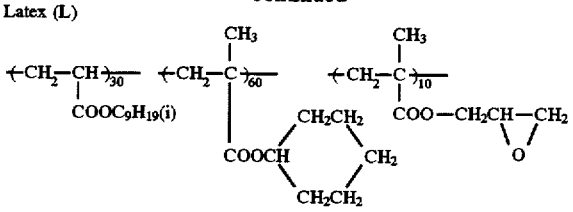

Polysiloxane (SI)

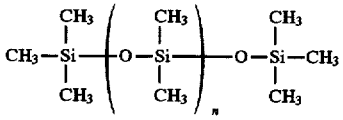

n ≈ 1000

Solid fine particle dispersion dye (AH)

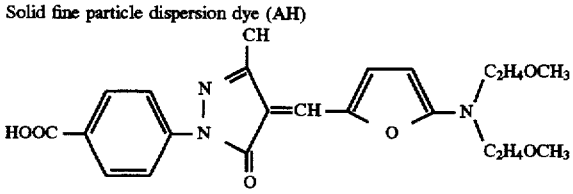

Compound (O)

$C_{11}H_{23}CONH(CH_2CH_2O)_5H$

Compound (M)

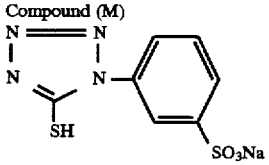

Compound (N)

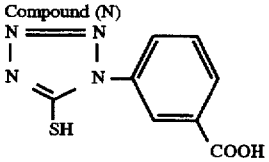

Coated amount of the additives is expressed in terms of weight coated on one surface of the support. Coated amount of silver was adjusted to be 1.6 g/m$^2$ with respect to one surface.

Next, compositions of the developing solution and the fixing solution used in the present invention are shown below:

<Composition of the developing solution> part-A(for 12 liter)

| | |
|---|---|
| Potassium hydroxide | 600 g |
| Potassium sulfite (50% aqueous solution) | 2180 g |
| Diethylenetetraminepentaacetic acid | 100 g |
| Sodium hydrogencarbonate | 240 g |
| 5-methylbenztriazole | 1.2 g |
| 1-phenyl-5-mercaptotetrazole | 0.2 g |
| 1-Phenyl-4-hydroxymethyl-4-methyl-3-pyrazolidone | 200 g |
| Hydroquinone | 340 g |
| Add water to make the total volume 5000 ml | |

Part-B (for 12 liter)

| | |
|---|---|
| Glacial acetic acid | 170 g |
| Triethyleneglycol | 324 g |
| 1-Phenyl-3-pyrazolidone | 21.6 g |
| n-Acetyl-D,L-penicilamine | 2.4 g |

Preparation of the developing solution is done by simultaneously adding Part-A and Part-B to approximately 5 liter water and while dissolving by agitation, add water to make the total volume 12 liters, and adjust pH of the solution at 10.60 with KOH.

To 1 liter of this developing solution 2.4 g/l of glacial acetic acid and 7.9 g/l of potassium bromide were added, and pH was adjusted at 10.45 with KOH, to make the developing solution for use.

<Composition of the fixing solution>

Concentrated fixing solution-1

(for the total volume of 18 liters; for comparison)

| | |
|---|---|
| Pure water | 2600 g |
| Sodium sulfite | 450 g |
| Boric acid | 108 g |
| Acetic acid (90%) | 1080 g |
| Sodium acetate | 630 g |
| 1-(N,N-dimethylamino)ethyl-5-mercaptotetrazole | 18 g |
| Aluminium sulfate | 185 g |
| Ammonium thiosulfate (70 wt/vol %) | 6000 g |

Concentrated fixing solution-2

(for the total volume of 18 liters)

| | |
|---|---|
| Pure water | 2600 g |
| Sodium sulfite | 450 g |
| Boric acid | 108 g |
| Compound represented by formula (I) added amount disclosed in Table 1. | |
| 1-(N,N-dimethylamino)ethyl-5-mercaptotetrazole | 18 g |
| Aluminium sulfate | 185 g |
| Ammonium thiosulfate (70 wt/vol %) | 6000 g |

Concentrated fixing solution-3

(for the total volume of 18 liters)

| | |
|---|---|
| Pure water | 2600 g |
| Sodium sulfite | 450 g |
| Boric acid | 108 g |
| Compound represented by formula (I) added amount disclosed in Table 1. | |
| 1-(N,N-dimethylamino)ethyl-5-mercaptotetrazole | 18 g |
| Aluminum sulfate | 185 g |
| Ammonium thiosulate (70 wt/vol %) | 6000 g |

Preparation of the fixing solutions-1 through 3 were carried out by diluting the concentrated fixing solutions-1 through 3 respectively with water to make the total volume of 18 liters. Further, before diluting by water, sulfric acid or sodium hydroxide is added in order that each pH of making up fixing solutions is adjusted to be 4.35.

(Evaluation of drying property)

Using 10 inch×12 inch-size unexposed films, processing was carried out under the conditions mentioned above and the drying property was evaluated with a hand-touch at the outlet mouth of the processor according to the following five grades:

(Standards for Evaluation)

A: Excellent: Completely dried and the sample is warm.

B: Good: Completely dried but part of the sample is cool.

C: Fair: Dried and no problem for practical use, although the sample is cool.

D: Poor: Edge portion of the sample is wet.

E: Very poor: Whole surface of the sample is wet.

(Evaluation of residual color)

Residual color of the above-mentioned non-exposed sample films was evaluated by visual observation.

(Standards for Evaluation)

A: Excellent: Not observed

B: Good: Slightly observed, no problem for practical use.

C: Fair: Observed, no problem for practical use.

D: Poor: Observed, problem for practical use.

E: Very poor: Remarkably observed, and can not employed.

(Preservation under cool temperatures)

When the above mentioned fixing solutions-1 to 3 were stored at −5° C., number of days, until when precipitation of crystals was observed, was recorded. Results are shown in Table 1.

TABLE 1

| No. | Fixing Solution | Compound | Amount (mol/l) | Replenishing Amount (ml/m²) | Drying Property | Residual Color | Storage property under cool temperatures (days) |
|---|---|---|---|---|---|---|---|
| 1 | (1) | | | 450 | D | C | 5 |
| 2 | (1) | | | 200 | E | E | 5 |
| 3 | (2) | 1 | 1.25 | 200 | B | B | Not occurred |
| 4 | (2) | 1 | 1.55 | 450 | A | A | 60 |
| 5 | (2) | 1 | 1.55 | 200 | A | B | 60 |
| 6 | (2) | 4 | 1.35 | 200 | A | A | 80 |
| 7 | (2) | 6 | 1.27 | 450 | A | A | Not occurred |
| 8 | (2) | 6 | 1.27 | 200 | B | B | Not occurred |
| 9 | (2) | 6 | 1.42 | 200 | A | A | Not occurred |
| 10 | (2) | 12 | 1.4 | 200 | A | A | 80 |
| 11 | (2) | 22 | 1.3 | 200 | A | A | 30 |
| 12 | (3) | 1 | 0.9 | 450 | B | A | Not occurred |
| 13 | (3) | 1 | 0.9 | 200 | C | B | Not occurred |
| 14 | (3) | 1 | 1.12 | 200 | B | A | 50 |

TABLE 1-continued

| No. | Fixing Solution | Compound | Amount (mol/l) | Replenishing Amount (ml/m²) | Drying Property | Residual Color | Storage property under cool temperatures (days) |
|---|---|---|---|---|---|---|---|
| 15 | (3) | 4 | 0.98 | 200 | B | A | 70 |
| 16 | (3) | 4 | 1.1 | 200 | A | A | 50 |
| 17 | (3) | 6 | 0.92 | 200 | B | B | Not occurred |
| 18 | (3) | 6 | 1.03 | 200 | A | B | Not occurred |
| 19 | (3) | 12 | 1.01 | 200 | A | B | 70 |
| 20 | (3) | 22 | 0.94 | 200 | B | A | 25 |

It is obviously understood from Table 1 that the fixing solutions prepared according to the present invention(Nos.3 through 20 exert remarkably improved results in drying property, residual color and storage property under cool temperatures compared with the comparative fixing solutions.(Nos.1 and 2).

Further, it is also clear that these properties are maintained in the case of reduced replenishment of less than 400 ml/m².

Example 2

In this example, the same light-sensitive material and the same developing solution prepared in Example 1 were used. Composition of the fixing solution used in this example is shown below:

<Composition of the fixing solution>

Concentrated fixing solution-4

(for the total volume of 18 liters; for comparison)

| | |
|---|---|
| Pure water | 2600 g |
| Sodium sulfite | 450 g |
| Boric acid | 108 g |
| Acetic acid (90%) | 1080 g |
| Sodium acetate | 630 g |
| 1-(N,N-dimethylamino)ethyl-5-mercaptotetrazole | 18 g |
| Ammonium thiosulfate (70 wt/vol %) | 6000 g |

Concentrated fixing solution-5

(for the total volume of 18 liters for comparison)

| | |
|---|---|
| Pure water | 2600 g |
| Sodium sulfite | 450 g |
| Boric acid | 108 g |
| Acetic acid (90%) | 1080 g |
| Sodium acetate | 630 g |
| 1-(N,N-dimethylamino)ethyl-5-mercaptotetrazole | 18 g |
| Ammonium thiosulate (70 wt/vol %) | 6000 g |

Concentrated fixing solution-6

(for the total volume of 18 liters)

| | |
|---|---|
| Pure water | 2600 g |
| Sodium sulfite | 450 g |
| Boric acid | 108 g |
| Compound represented by formula (I) | added amount disclosed in Table 2. |
| 1-(N,N-dimethylamino)ethyl-5-mercaptotetrazole | 18g |
| Aluminium sulfate | 185g |
| Ammonium thiosulate (70 wt/vol %) | 6000g |

Concentrated fixing solution-7

(for the total volume of 18 liters)

| | |
|---|---|
| Pure water | 2600 g |
| Sodium sulfite | 450 g |
| Boric acid | 108 g |
| Compound represented by formula (I) | added amount disclosed in Table 2. |
| 1-(N,N-dimethylamino)ethyl-5-mercaptotetrazole | 18 g |
| Aluminium sulfate | 185 g |
| Ammonium thiosulate (70 wt/vol %) | 6000 g |

Concentrated fixing solution-8

(for the total volume of 18 liters)

| | |
|---|---|
| Pure water | 2600 g |
| Sodium sulfite | 450 g |
| Boric acid | 108 g |
| Acetic acid (90%) | 450 g |
| Compound represented by formula (I) | added amount disclosed in Table 2. |
| 1-(N,N-dimethylamino)ethyl-5-mercaptotetrazole | 18 g |
| Ammonium thiosulate (70 wt/vol %) | 6000 g |

Concentrated fixing solution-9

(for the total volume of 18 liters)

| | |
|---|---|
| Pure water | 2600 g |
| Sodium sulfite | 450 g |
| Boric acid | 108 g |
| Acetic acid (90%) | 450 g |
| Compound represented by formula (I) | added amount disclosed in Table 2. |
| 1-(N,N-dimethylamino)ethyl-5-mercaptotetrazole | 18 g |
| Aluminium sulfate | 185 g |
| Ammonium thiosulate (70 wt/vol %) | 6000 g |

The fixing solutions-4 through 9 were prepared by diluting the concentrated fixing solutions-4 through 9 with water to make the total volume of each to be 18 liters. Further, before diluting by water, sulfuric acid or sodium hydroxide is added in order that each pH of making up fixing solutions is adjusted to be 4.35.

Processing of the above-mentioned light-sensitive material can be conducted by the use of a modified automatic processor SRX-503 a product of Konica Corporation for X-ray film, wherein the above mentioned developing solutions and the above-mentioned fixing solutions-4 through 9 were put in the processing baths of said processor, and, under the dry to dry condition of 25 secs, 254 mm×306 mm size films were processed continuously until the time when the processing level reached a state of equilibrium. The light-sensitive material was exposed uniformly so that it produces transparent density level at 1.0 after processing. As for replenishing, the developer replenishing solution and the fixing solutions 4 to 9 were used.

Replenishing amount of the developing solution was 200 ml/m$^2$ and, with respect to the fixing solution, added amount is disclosed in Table 2. Temperatures of the processing was 35° C., 33° C., 20° C. and 50° C. with respect to the development, fixing, washing and drying, respectively.

(Evaluation of drying property)

Using 10 inch×12 inch-size unexposed films, processing was carried out under the above conditions and the drying property was evaluated with a hand-touch at the outlet mouth of the processor according to the following five grades:

(Standards for Evaluation)

A: Excellent: Completely dried and the sample is warm.

B: Good: Completely dried but part of the sample is cool.

C: Fair: Dried and no problem for practical use, although the sample is cool.

D: Poor: Edge portion of the sample is wet, and problem for practical use.

E: Very poor: Whole surface of the sample is wet, and can not employed.

(Evaluation of drying uneveness)

Using 10 inch×12 inch size developed films in solid black. uneven drying of the films was evaluated by visual observation at the outlet mouth of the automatic processor based on the following five grading standards.

(Standards for evaluation)

A: Excellent: Not observed

B: Good: Slightly observed, no problem for practical use.

C: Fair: Observed, but no problem for practical use.

D: Poor: Observed, and problem for practical used.

E: Very poor: Remarkably observed, and can not employed.

(Evaluation of the fixing stain)

Adhesion material onto the above-mentioned developed films in solid black is evaluated according to the following four standards by visual observation.

(Standards for evaluation)

A: Excellent: No adhesion observed.

B: Good: Slightly observed, no problem for practical use.

C: Poor: Observed, and problem for practical use.

D: Very poor: Observed, and can not employed.

Results are shown in Table 2.

TABLE 2

| No. | Fixing Solution | Exemplified Compound | Amount (mol/l) | Replenishing Amount (ml/m$^2$) | Drying property | Drying uneveness | Fixing stain |
|---|---|---|---|---|---|---|---|
| 1 | (4) | | | 450 | D | C | C |
| 2 | (4) | | | 200 | E | E | D |
| 3 | (5) | | | 450 | B | B | E |
| 4 | (5) | | | 200 | C | D | E |
| 5 | (6) | 1 | 1.25 | 200 | B | B | B |
| 6 | (6) | 1 | 1.55 | 450 | A | A | B |
| 7 | (6) | 1 | 1.55 | 200 | A | A | B |
| 8 | (6) | 6 | 1.27 | 450 | A | A | B |
| 9 | (6) | 6 | 1.27 | 200 | B | A | B |
| 10 | (6) | 6 | 1.42 | 200 | A | A | B |
| 11 | (6) | 12 | 1.4 | 200 | A | A | B |
| 12 | (6) | 22 | 1.3 | 200 | A | B | B |
| 13 | (7) | 1 | 1.25 | 200 | B | C | D |
| 14 | (7) | 1 | 1.55 | 450 | A | B | C |
| 15 | (7) | 1 | 1.55 | 200 | A | B | E |
| 16 | (7) | 6 | 1.27 | 450 | A | A | C |
| 17 | (7) | 6 | 1.27 | 200 | B | B | D |
| 18 | (7) | 6 | 1.42 | 200 | A | A | E |
| 19 | (7) | 12 | 1.4 | 200 | A | A | D |
| 20 | (7) | 22 | 1.3 | 200 | A | B | D |
| 21 | (8) | 1 | 0.9 | 200 | B | B | B |
| 22 | (8) | 1 | 0.9 | 450 | B | B | B |
| 23 | (8) | 1 | 1.12 | 200 | B | B | B |
| 24 | (8) | 6 | 0.92 | 450 | A | A | B |
| 25 | (8) | 6 | 0.92 | 200 | B | A | B |
| 26 | (8) | 6 | 1.03 | 200 | A | A | B |
| 27 | (8) | 12 | 1.01 | 200 | A | A | B |
| 28 | (8) | 22 | 0.94 | 200 | B | B | B |
| 29 | (9) | 1 | 0.9 | 200 | C | D | D |
| 30 | (9) | 1 | 0.9 | 450 | B | C | C |
| 31 | (9) | 1 | 1.12 | 200 | B | C | E |
| 32 | (9) | 6 | 0.92 | 450 | A | B | C |
| 33 | (9) | 6 | 0.92 | 200 | B | C | D |
| 34 | (9) | 6 | 1.03 | 200 | A | B | E |
| 35 | (9) | 12 | 1.01 | 200 | A | B | D |
| 36 | (9) | 22 | 0.94 | 200 | B | C | D |

As is apparent from Table 2 that the fixing solutions Nos.5 through 12 and Nos.21 through 28 show excellent results in drying property, uneveness drying and fixing stain. In addition, the fixing solutions Nos.13 through 20 and Nos.29 through 36 show excellent results in drying property and uneveness drying. Further, it is also clear that these improved results are obtained in the case of replenishing amount of not more than 400 ml/m$^2$.

What is claimed is:

1. A fixing solution, having a pH of 4.2 to 5.5, for a silver halide light-sensitive material comprising a compound selected from the group consisting of 1. $HO—CH_2CH_2COOH$
2. $HO—CH_2—CH_2—CH_2COOH$
3. $HO—CH_2—CH_2—CH_2—CH_2COOH$
4. $CH_3—CH(OH)—CH_2COOH$
5. $CH_3—CH(OH)—CH_2—CH_2COOH$
6. $H_2N—CH_2—CH_2COOH$
7. $H_2N—CH_2—CH_2—CH_2COOH$
8. $H_2NCH_2—CH_2—CH_2—CH_2COOH$
9. $HO_3S—CH_2—CH_2COOH$
10. $HO_3S—CH_2—CH_2—CH_2COOH$
11. $HO_3S—CH_2—CH_2—CH_2—CH_2COOH$
12. $O_2N—CH_2—CH_2COOH$
13. $O_2N—CH_2—CH_2—CH_2COOH$
14. $O_2N—CH_2—CH_2—CH_2—CH_2COOH$
15. $Cl—CH_2—CH_2COOH$
16. $Cl—CH_2—CH_2—CH_2COOH$
17. $Cl—CH_2—CH_2—CH_2—CH_2COOH$
18. $Br—CH_2—CH_2COOH$
19. $Br—CH_2—CH_2—CH_2COOH$
20. $CH_3—CHBr—CH_2COOH$
21. $Br—CH_2—CH_2—CH_2—CH_2COOH$
22. $I—CH_2—CH_2COOH$
23. $H_2N—CH_2—CH(OH)—CH_2—CH_2COOH$
24. $HO—CH_2—C(CH_3)_2—CH(OH)—CO—NH—CH_2COOH$
25. $H_2N—CH(OH)—CH_2—CH_2—CH_2COOH$.

2. The fixing solution of claim 1, wherein an aluminium hardening agent is contained in said fixing solution.

3. The fixing solution of claim 1, wherein an aiuminium hardening agent is not contained in said fixing solution.

4. The fixing solution of claim 2, wherein said aluminium hardening agent is an aluminum sulfate or an alum.

5. The fixing solution of claim 1, wherein said compound represented by Formula I is contained in an amount of 0.05 to 3 mol per liter of said fixing solution.

6. The fixing solution of claim 1, wherein said compound represented by Formula I is contained in an amount of 0.1 to 2 mol per liter of said fixing solution.

7. The fixing solution of claim 1, wherein said fixing solution comprises a compound selected from the group consisting of a citric acid, a tartaric acid, a malic acid, a succinic acid, phenylacetic acid and an optical isomer thereof.

8. The fixing solution of claim 1 containing a thiosulfate as a fixing agent.

9. The fixing solution of claim 8 containing 0.1 to 5 mol/l of said thiosulfate.

10. The fixing solution of claim 8 containing 0.8 to 2 mol/l of said thiosulfate.

11. The fixing solution of claim 8 containing 0.7 to 1.8 mol/l of said thiosulfate.

12. The fixing solution of claim 8 containing a sulfite.

13. The fixing solution of claim 12 containing not more than 0.2 mol/l of said sulfite.

14. The fixing solution of claim 7 containing not less than 0.05 mol/l of said compound.

15. The fixing solution of claim 7 containing 0.2 to 0.6 mol/l of said compound.

* * * * *